United States Patent [19]

de la Haye

[11] Patent Number: 4,615,279

[45] Date of Patent: Oct. 7, 1986

[54] VERTICALLY ADJUSTABLE TABLE

[76] Inventor: Cornelis F. de la Haye, Starrenboschstraat 11, 1097 MB Amsterdam, Netherlands

[21] Appl. No.: 806,027

[22] Filed: Dec. 6, 1985

Related U.S. Application Data

[63] Continuation-in-part of Ser. No. 684,614, Dec. 21, 1984, abandoned.

[51] Int. Cl.[4] ..... A47B 9/00

[52] U.S. Cl. ..... 108/144; 108/147; 108/7; 108/64; 108/65

[58] Field of Search ..... 108/144, 147, 96, 7, 108/8, 59, 64, 65; 248/405, 404, 161, 354.3, 396, 394

[56] References Cited

U.S. PATENT DOCUMENTS

| | | | |
|---|---|---|---|
| 1,957,785 | 5/1934 | Knapp | 248/394 |
| 2,368,748 | 2/1945 | Doty | 108/147 |
| 3,385,238 | 5/1968 | Jay | 108/144 |
| 3,648,628 | 3/1972 | Davis | 108/65 X |
| 3,741,852 | 6/1973 | Keener | 108/64 X |
| 3,802,002 | 4/1974 | Jonas | 108/147 X |
| 3,880,394 | 4/1975 | Wisecarver | 248/354.3 X |
| 4,409,906 | 10/1983 | Alneng | 108/64 |

FOREIGN PATENT DOCUMENTS

| | | | |
|---|---|---|---|
| 257088 | 9/1967 | Austria | 108/144 |
| 83101183 | 4/1983 | PCT Int'l Appl. | 108/147 |

*Primary Examiner*—William E. Lyddane
*Assistant Examiner*—José V. Chen
*Attorney, Agent, or Firm*—Jacobs & Jacobs

[57] ABSTRACT

A table comprising two or more legs, at least one leg being fitted with a height adjustment mechanism, all legs being fitted with adjustment mechanisms that are adjustable both in separate and in interconnected relationship.

6 Claims, 5 Drawing Figures

VERTICALLY ADJUSTABLE TABLE

The present application is a continuation-in-part of my copending application Ser. No. 684,614, filed Dec. 21, 1984 now abandoned entitled "A Table", which is incorporated herein by reference thereto.

The invention relates to a table comprising two or more legs, at least one leg being fitted with a height adjustment mechanism. Such tables are generally known, e.g. tables for a slide projector, a drawing table and the like.

It is an object of the invention to construct a table so that it is both horizontally adjustable and conveniently adjustable in height.

To this effect, a table of the above described type is characterized in that all legs are fitted with adjustment mechanisms that are adjustable both in separate and in interconnected relationship. Said leg adjustment mechanisms may consist of connectable worm wheel transmissions which can be driven both manually and by means e.g. of an electric motor.

To facilitate the adjustment, the worms may be interconnected by a detachable connecting rod fitted with a telescopically resilient portion. As a result, the legs can first be adjusted each separately, so that the table (at least the top) is in horizontal position and/or all legs are bearing and subsequently the connecting rod is mounted, after which the table in the horizontal position can be displaced in vertical direction.

When the legs are interspaced so that when the table is loaded, deflection thereof is feared, it is possible to dispose around the coupling element or the connecting rod a tube connected at each end pivotally to the respective leg. As a result, an additional support for the table top is provided and, moreover, the connecting rod is covered.

When use is made of a table comprising a central portion and at least one wing linking up therewith, of an optional shape or size, the connection between the wing and the central portion can extend according to a curved line of separation and the portions can be interconnected by a tie member. By using a curved line of separation, a considerably greater stability is obtained than in case a straight line of separation is used. Adjacent said line of separation, the central portion and the wing may each be provided with a groove, in which grooves there is provided a connecting strip. By using reversible wings, these can be arranged both at the left and at the right of the central portion.

In order to ensure a good stability of the legs separately, each leg may consist of at least two telescopically coacting portions.

One embodiment of the table according to the invention will now be described, by way of example, with reference to the accompanying drawings, in which.

Figures 1, 2:
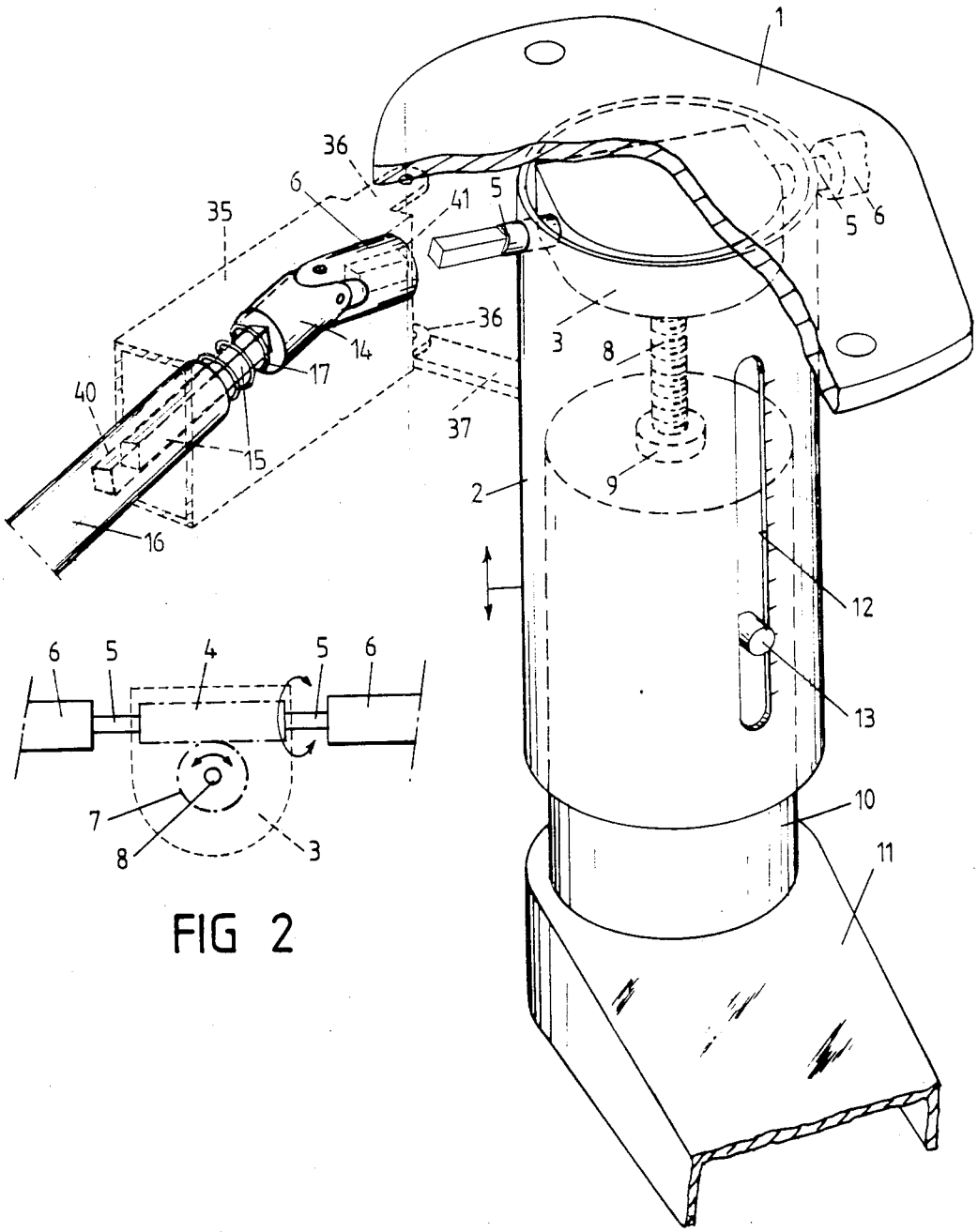
FIG. 1 is a perspective view, with partly exploded parts, of a leg adjustment mechanism.
FIG. 2 is a top view of the worm-worm wheel transmission used in the apparatus shown in FIG. 1.

As shown in the drawings, a leg adjustment mechanism comprises an attachment plate 1 to which a depending jacket 2 is attached in a manner not shown, and a casing 3 for a worm-worm wheel transmission. The latter is further diagrammatically shown in FIG. 2: a worm 4 is fitted towards both ends with a worm stub shaft 5, to which a universal joint portion 6 with a recess 41 is attached. A worm wheel 7 is secured (against rotation) on a threaded shaft 8. This threaded shaft is received in a nut 9, which is affixed to the top of a support 10 fitted with a foot 11. As shown in FIG. 1, the jacket 2 is fitted with a slot 12, receiving a pin 13 affixed to the support 10. The edge of the slot may be fitted with a dimensioning, not further shown.

It will be clear that by rotation of the worm 4, the height of the attachment plate 1 can be adjusted selectively.

Figure 3:
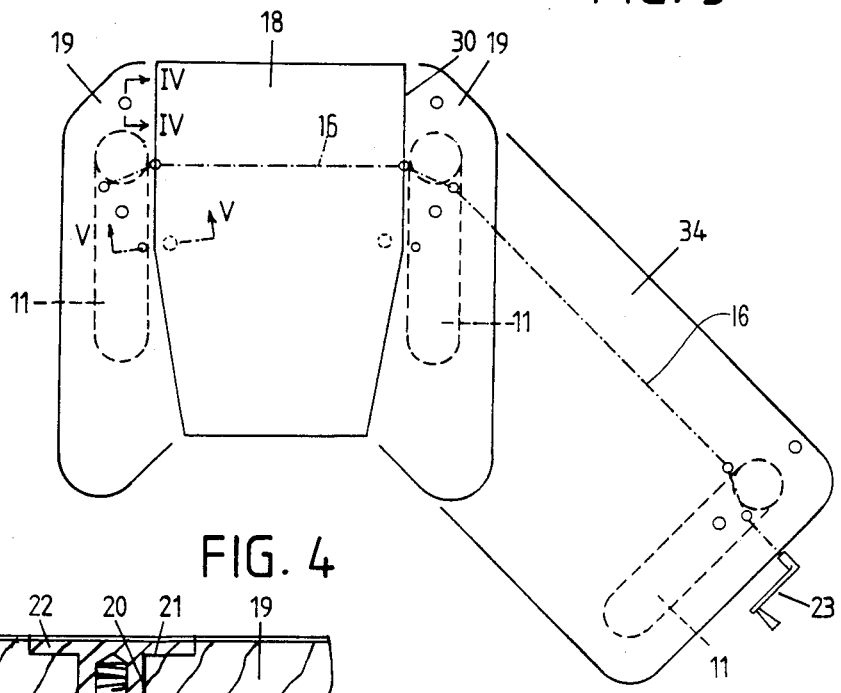
FIG. 3 is a top view of a table top.

The top view of a table top shown in FIG. 3 diagrammatically shows a central portion 18 and wings 19 linking up therewith by means of a curved line of separation 30. Instead of the wings 19, use can also be made of the wing 34 shown at the right in FIG. 3. Naturally, also wings of different formats or sections, or a plurality of wings one behind the other are possible.

Underneath each wing, there is represented a leg adjustment mechanism 1–10 with a foot 11. As shown in FIG. 3, the leg adjustment mechanisms are interconnected by means of connecting rods 16. In particular, a connecting rod is provided between and interconnects the pair of leg adjustment mechanisms under wings 19, 19 (FIG. 3) and the pair of leg adjustment mechanisms under 34 and the adjacent wing 19 (FIG. 3). With reference to FIG. 1, to assemble the rods 16 to the pairs of opposed leg adjustment mechanisms, a compression spring 17 is slipped over each pin 15 of a pair of opposed joints 14, and a pin 15 of each joint 14 is slid into a recess 40 at one end of rod 16. The universal joint portion 6 is then forced against the compression spring 17, whereby pin 15 fully enters recess 40 thus providing enough clearance for attaching the recess 41 over the worm stub shaft 5. The pin 15 of the joint 14 and the recess 40 should of course be of a length enough to maintain the connection after the releasing of the spring. The pair of springs 17 at each end of rod 16 thus attaches the rod 16 to the pair of joints 14. To disassemble the rods 16 from the joints 14, the above procedure is reversed.

Connecting rod 16 thus detachably interconnects the leg adjustment mechanisms through the use of telescopically resilient means provided by the recess 40, pin 15 and spring 17.

The central axes of the worm shafts and the connecting rods 16 may be at an angle relative to each other different from 180°.

The leg adjustment mechanism mounted underneath the wing 34 is fitted at the projecting free universal joint portion 6 with a detachable or non-detachable crank 23 adapted to adjust the coupled leg adjustment mechanisms.

In order to prevent, especially with larger top formats, a deflection thereof, it is possible, as shown in dotted lines in FIG. 1, to provide a cross-sectionally rectangular tube 35 having lugs 36, the central axis of which extends through the pivot point of the universal joint 6,14. The lugs 36 are rotatably connected, by elements not shown to the attachment plate 1, and a support 37, attached to the jacket 2, respectively.

Figure 4:
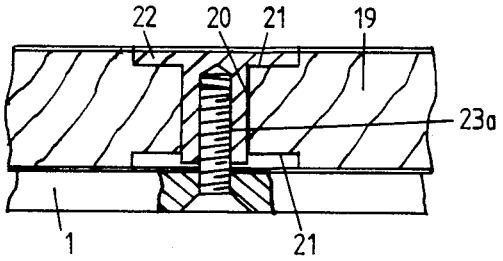
FIG. 4 is a cross-section on the line IV—IV of FIG. 3.

The cross-section shown in FIG. 4 shows the attachment of the attachment plate 1 to the wing 19. As shown in the Figure, the wing 19 is fitted with a bore 20 having edge holes 21. In said bore and one of the edge holes, there is received an internally threaded bush 22. A screw 23*a* extending through an opening in the attachment plate 1 is adapted to coact with the bush.

Figure 5:
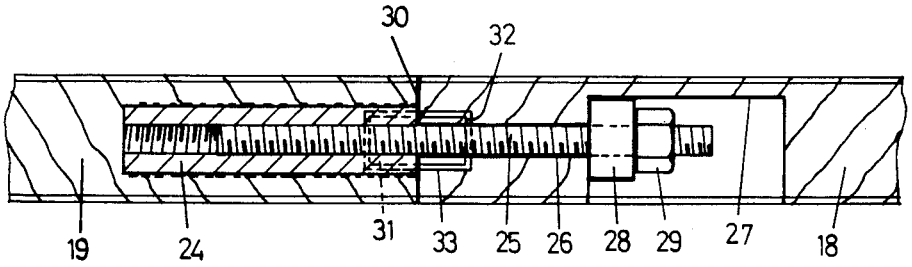
FIG. 5 is a cross-section on the line V—V of FIG. 3.

The cross-section shown in FIG. 5 finally shows the attachment of the central portion 18 to the wing 19. In the wing 19 there is provided a hole, not further shown, wherein there is arranged both an internally and an externally threaded bush 24. The bush 24 coacts with a screwed spindle 25, the projecting end of which extends through a recess 26 in the central portion 18.

The screwed spindle 25 extends through the recess 26 into a recess 27 and is fitted at that location with a washer 28 and a nut 29. By tightening the nut 29, the wing is firmly pulled against the central portion 18.

As further shown in FIG. 5, both the central portion 18 and the wing 19, at the line of separation 30, is fitted with a recess 31, 32, wherein a connecting strip 33 is received.

The table according to the invention is particularly suitable among other things for placing thereon a computer-liked terminal, while the terminal itself can be arranged on the central portion and auxiliary appliances, if any, and forms, respectively, can be disposed on the wing(s).

It will be clear that a great many variants are possible without departing from the scope of the invention, depending on the tasks to be performed on the table and the requirements to be set thereto.

I claim:

1. A table comprising a central portion, at least one wing portion, means attaching each said wing portion to said central portion, first and second legs connected to a respective one of said portions and a third leg connected to one of said portions at a position intermediate said first and second legs, and leg adjustment means provided at each said leg for changing the height of said portions, said leg adjustment means comprising a worm wheel transmission at each said leg and a connecting rod means detachably connected between said worm wheel transmission of said third leg and the worm wheel transmissions of said first and second legs, said connecting rod means having a rod member and universal joint members resiliently connected at each end thereof for telescopic movement relative to said rod member, said universal joint members being detachably connected to a said worm wheel transmission, whereby said connecting rod means can be connected to and detached from said worm wheel transmissions as wing portions are attached to said central portion and to each other, said leg adjustment means being operably connected together through said connecting rod means to raise or lower said legs in unison.

2. A table according to claim 1 wherein said worm-worm wheel transmissions at said legs are connected to universal joints.

3. A table according to claim 2, wherein a tube is arranged around the connecting rod means, said tube being pivotally connected at each end to the respective leg, with the pivot axis of the tube coinciding with the pivot axis of the universal joint.

4. A table according to claim 1, comprising a central portion and at least one wing portion connected therewith, the connection between the wing portion and the central portion extending in a curved line of separation, said portions being interconnected by one tie member.

5. A table according to claim 4, wherein the central portion and the wing portion at said line of separation are each provided with a groove, in which grooves there is provided a connecting strip.

6. A table according to claim 1, wherein each leg comprises at least two telescopically coacting portions.

* * * * *